US005600982A

United States Patent [19]

Berger

[11] Patent Number: 5,600,982

[45] Date of Patent: Feb. 11, 1997

[54] METHOD FOR SUPPRESSING THE INFLUENCE OF ROLL ECCENTRICITIES ON THE CONTROL OF THE ROLLED PRODUCT THICKNESS IN A ROLL STAND

[75] Inventor: Klaus-Dieter Berger, Höchstadt, Germany

[73] Assignee: Siemens Aktiengesellschaft, Munich, Germany

[21] Appl. No.: 403,920

[22] PCT Filed: Sep. 20, 1993

[86] PCT No.: PCT/DE93/00894

§ 371 Date: Mar. 22, 1995

§ 102(e) Date: Mar. 22, 1995

[87] PCT Pub. No.: WO94/06578

PCT Pub. Date: Mar. 31, 1994

[30] Foreign Application Priority Data

Sep. 22, 1992 [DE] Germany ..... 42 31 615.4

[51] Int. Cl.[6] ..... B21B 37/00

[52] U.S. Cl. ..... 72/9.2; 72/10.1; 72/11.8

[58] Field of Search ..... 72/9.2, 10.1, 11.8, 72/13.4, 16.9, 10.3, 12.1

[56] References Cited

U.S. PATENT DOCUMENTS

| | | | |
|---|---|---|---|
| 4,531,392 | 7/1985 | Puda | 72/9.2 |
| 4,648,257 | 3/1987 | Oliver et al. | 72/9.2 |
| 4,763,273 | 8/1988 | Anbe et al. | 72/10.3 |
| 4,850,211 | 7/1989 | Sekiguchi et al. | 72/10.3 |
| 5,077,997 | 1/1992 | Wolters et al. | 72/9.2 |
| 5,341,663 | 8/1994 | Knapp | 72/9.2 |

OTHER PUBLICATIONS

Stahl Und Eisen, vol. 93, No. 10, 10 May 1973, Düsseldorf, DE, pp. 429–435; Hermann Steffens et al.: *Systemstudie, Ausführung und Ergebniskontrolle einer Dickenregelung mit hydraulischem Stellglied für eine Kaltwalzumkehrstrasse.*

Wissenschaftliche Zeitschrift, University Magdeburg, vol. 31, (1987), No. 6, pp. 80–83; Gero Nessler: *Untersuchungen von Störgrössen an hydraulisch anstellbaren Walzgerüsten.*

Nippon Steel Technical Report No. 49, Apr. 1991, pp. 59–62; Akihiko Hasegawa et al.: *Development of Fuzzy Set Theory–Based Shape Control System for Cold Strip Mill.*

Derwent Abstract Of SU 1696 027, Dec. 7, 1991: *Control of Multistand rolling mills . . .*

*Primary Examiner*—Lowell A. Larson
*Assistant Examiner*—Ed Tolan
*Attorney, Agent, or Firm*—Kenyon & Kenyon

[57] ABSTRACT

In the control of the rolled product thickness in a roll stand, to suppress the influence of roll eccentricities, it is known to provide a dead zone which is insensitive to signal fluctuations caused by the roll eccentricities and to vary the zone width of the dead zone as a function of the magnitude of the signal fluctuations. In so doing, in order to increase the accuracy, the variation of the zone width (b) is carried out as a function of a continuous statistical evaluation of the signal fluctuations, the standard deviation (σ) thereof preferably being determined.

9 Claims, 3 Drawing Sheets

METHOD FOR SUPPRESSING THE INFLUENCE OF ROLL ECCENTRICITIES ON THE CONTROL OF THE ROLLED PRODUCT THICKNESS IN A ROLL STAND

BACKGROUND OF THE INVENTION

The present invention relates generally to methods for suppressing the influence of roll eccentricities on the control of the rolled product thickness in a roll stand, and more particularly to a method for suppressing the influence of roll eccentricities on the control of the rolled product thickness in a roll stand in which provision is made in the control of a dead zone which is insensitive to signal fluctuations caused by the roll eccentricities the zone width of the dead zone being varied as a function of the magnitude of the signal fluctuations.

In the control of the rolled product thickness in a roll stand, the difficulty exists that the rolled product thickness, as controlled variable of interest, cannot simply be measured in terms of control in an evaluable way at the location of its production, namely the roll gap, and can therefore not be used for directly controlling out disturbances such as, for example, eccentricities of the rolls. However, in accordance with the so-called gage meter principle, the instantaneous rolled product thickness $h_a$ in the region of the roll gap can be determined by computation from the setting position s of the rolls, the rolling force FW and the spring constant $c_G$ of the roll stand as $$h_a + \Delta R = s + \frac{F_w}{c_G} \tag{1}$$

In the case of the so-called automatic gage control (AGC) method, proceeding from this relationship, the rolling force is detected by means of a rolling force detector and is used for controlling the rolled product thickness. If the roll gap is increased, for example because of an increase in the entry thickness of the rolled product, this leads to an increase in the rolling force FW; this increase is detected, and the setting position s of the rolls is reduced by the control, so that the rolling force FW is further increased and the rolled product thickness is controlled back again to its desired value. However, as equation (1) shows, the rolled product thickness $h_a$ is not available on its own, but only together with the roll eccentricity $\Delta R$, which causes a periodic increase and decrease of the rolling force FW in the rolling process. The increases and decreases, caused by the eccentricities, of the rolling force FW are, however, falsely interpreted by the AGC system as increase and decrease, respectively, of the roll gap, as a result of which the rolling force FW is automatically increased and decreased respectively, via the setting position s and the eccentricities are thus rolled into the rolled product to their full extent.

In order to prevent this negative influence of the roll eccentricities on the control of the rolled product thickness, it is known from DE-C 26 43 686 to provide in the control a dead zone, which is insensitive with respect to signal fluctuations caused by the roll eccentricities. In this arrangement, the width of the dead zone is varied as a function of the amplitudes of the signal fluctuations and is thus matched to the extent of the eccentricities. For recording the amplitudes of the signal fluctuations, limiting value detectors having staggered response values and flip-flops arranged downstream from the limiting value detectors are used, as a result of which limits are placed on the accuracy.

The present invention is therefore directed to the problem of developing a method for suppressing the influence of roll eccentricities on the control of the rolled product thickness in a roll stand in which a dead zone is provided in the control, and in which the match of the width of the dead zone as a function of the eccentricities occurring is optimized.

SUMMARY OF THE INVENTION

The present invention solves this problem by providing that the variation of the dead zone width is carried out as a function of a continuous statistical evaluation of the signal fluctuations. In this manner, account is taken of the circumstance that the influence of the roll eccentricities on the control of the rolled product thickness and hence the corresponding signal fluctuations in the control are not easily predictable variables, because of which their recording and evaluation for the control is carried out in an advantageous manner by means of the statistical signal evaluation.

According to an advantageous development of the method according to the present invention, the standard deviation of the signal fluctuations from their mean value is used to determine the zone width. Using the standard deviation, a variable reproducing in an optimal fashion the actual extent of the eccentricity-dependent signal fluctuations is determined for adjusting the dead zone. Furthermore, the determination of the standard deviation can be carried out computationally in a particularly simple manner, as a result of which the hardware and software cost for implementing this computing function is comparatively small.

In matching the width of the dead zone, in order also to be able to take into account residual fluctuations occurring outside the standard deviation, the values continuously determined for the standard deviation are weighted by a prescribed factor of the order of approximately 1 to 4, preferably 2 to 3.

In order to ensure that, during the signal evaluation, those signal fluctuations are in fact used which are based on eccentricities of the rolls, provision is advantageously made for the statistical evaluation of the signal fluctuations to be based on an observation period which corresponds to the roll rotation period or a multiple thereof. In this way, it is taken into account that the signal fluctuations, in spite of their unpredictable, i.e., random, nature, correlate with the roll rotation.

For the same reason, corresponding to an advantageous development of the method according to the present invention, it is provided that, from the signal fluctuations, reference points are recorded for their statistical evaluation at a sampling frequency that has a fixed ratio with respect to the roll rotational speed. By this means there results a number which is independent of the roll rotational speed, of reference points within the observation period, as a result of which it is possible to prescribe in a fixed manner a specific computing capacity for the statistical evaluation.

In principle, within the control, signal fluctuations occurring at various locations can be used for setting the width of the dead zone, insofar as they correlate with the roll eccentricities. However, since the dead zone is provided for suppressing such signal fluctuations, the signal values present on the input side of the dead zone are preferably used for the statistical evaluation.

The accuracy in the case of the control of rolling processes is strongly dependent on the quality with which the process variables can be determined. In this case, there often result not individual values for the process variables but rather value ranges, the development of which is a function of the most diverse influences. To improve controlled variables in the control for a roll stand, provision being made in the control of a zone which is insensitive to signal fluctuations caused by roll eccentricities, the width of said zone being varied as a function of the signal fluctuations, it is therefore provided within the framework of the invention that the improvement of the zone width and of further influencing variables, e.g. for pre-control, is carried out on the basis of the techniques of the processing of fuzzily determined input variables, in particular taking into account expert knowledge with reference to the measured value variability and distribution occurring in the process variables.

An implementation, of the improvement of the control, which is cost-effective, rapid and in particular can be checked by means of computer simulation, as well as the possibility of matching the influencing of the results of the control by means of the neural network or the fuzzy computing process are achieved in an advantageous manner by means of the measures specified in the further subclaims.

DETAILED DESCRIPTION

Figure 1:
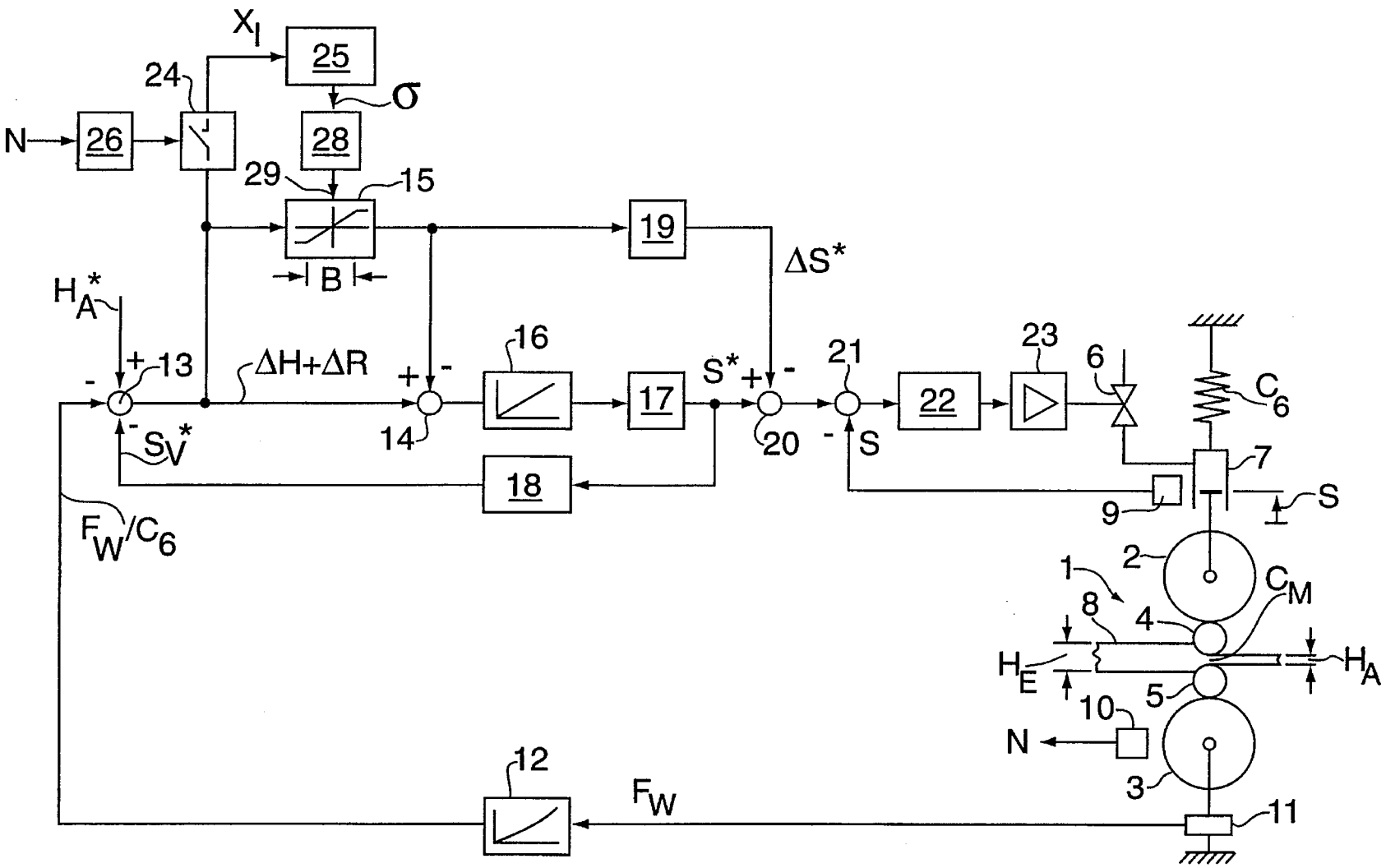
FIG. 1 shows a block circuit diagram for the control of the rolled product thickness in a roll stand.

FIG. 1 shows the block circuit diagram of an automatic gage control (AGC) for a roll stand 1 having an upper and lower supporting roll 2 and 3, two operating rolls 4 and 5, a hydraulic setting device 7, which can be actuated via a control valve 6, for setting the setting position s and a spring $c_g$ simulating the elasticity of the roll stand 1. The rolled product 8, which can be assigned an equivalent material spring $c_M$ in the roll gap, is rolled down by means of the two rolls 4 and 5 from an inlet thickness $h_c$ to an outlet thickness $h_a$. The roll eccentricities can be described by an effective change of the roll radius ΔR.

The setting position s is measured with a position pick-up 9 on the setting device 7; the supporting roll rotational speed n is recorded by means of a tachometer 10 on the supporting roll 3 and the rolling force FW is picked off by means of a pressure sensor 11 on the roll stand 1.

The measured actual value of the rolling force FW is fed to a matching amplifier 12 simulating the stand characteristic curve $c_G$, said amplifier generating on its output side the spring-back actual value $FW/c_G$. The spring-back actual value $FW/c_G$, is fed with a negative sign to a summing point 13, at which, corresponding to the above given equation (1), the desired value $h_a$* for the exit thickness of the rolled product 8 is compared with the actual value $h_a$ overlaid with the roll eccentricity ΔR, where $$h_a + \Delta R = s + \frac{F_w}{c_G}$$

For reasons specified in more detail hereinafter, however, instead of the actual value of the setting position s, a value $s_V$* is fed to the summing point 13. The difference signal at the output of the summing point 13 thus contains not only the difference Δh between the desired value $h_a$* and the actual value $h_a$ of the rolled product thickness, but also signal fluctuations caused by the eccentricities ΔR. In order to suppress these signal fluctuations ΔR within the control, the difference signal at the output of the summing point 13 is fed with a positive sign directly to a further summing point 14, to which the same difference signal is additionally fed with a negative sign via a limiter 15. The limiter 15 transmits, from the signal fed to it, only those signal amplitudes which lie within a range x corresponding preferably to the amplitudes of the eccentricities ΔR, with the result that exactly this amplitude range does not appear at the output of the summing element 14. The limiter 15 therefore forms, together with the further summing element 14, a dead zone for all signal amplitudes which lie within the range b. As is explained in more detail hereinafter, the width b of the dead zone is set in such a manner that it is insensitive to the signal fluctuations caused by the roll eccentricities ΔR.

The signal, freed from the eccentricity-dependent signal fluctuations ΔR, at the output of the summing point 14 is fed to a roll gap controller 16 having a correction amplifier 17 arranged downstream, at the output of which a desired value s* for the setting position appears. In the correction amplifier 17, the output signal of the roll gap controller 16 is multiplied by the factor $1+c_m/c_G$, in order thus to equalize the influence of the path amplification of the control loop with $$\frac{h_a}{s} = \frac{c_G}{(c_M + c_G)} \tag{3}$$

The desired value s* at the output of the correction amplifier 17 is coupled back as signal $s_V$* to the summing point 13 via a delay device 18 having a delay corresponding to the inherent delay of the position control (position controller 22). The output signal s* of the correction amplifier 17 is fed with a positive sign, and the output signal of the limiter 15 is fed, via a matching amplifier 19, with a negative sign, as additional desired value Δs* to a further summing point 20, at the output of which a final desired value for the setting position s* is generated. At the summing point 20, it is decided whether an increase or decrease of the rolling force FW is caused by an increase or decrease in the roll gap, for example because of the altering entry thickness of the rolled product 8, or whether, vice versa, it is caused by a decrease or increase in the roll gap 8 because of the roll eccentricities ΔR. In this case, the additional desired value Δs*, coming from the limiter 15 and fed via the matching amplifier 19 to the summing point 20, is used for compensating the roll eccentricities ΔR.

The final desired value for the setting position at the output of the summing point 20 is compared at an additional summing point 21 with the actual value s supplied by the position transmitter 9, the result of the comparison being used, via a position controller 22 and an actuator 23 arranged downstream, for actuating the control valve 6 and thus for influencing the setting position s.

In order to be able to match the width of the dead zone b, generated by the limiter 15 together with the summing point 14, to the respective amplitude of the roll eccentricities ΔR, reference points $x_i$ are first recorded from the difference signal at the output of the summing point 13 by means of a sampling element 24 and fed to a device 25 for the statistical evaluation of the reference points $x_i$. In the device 25, over an observation period of N reference points $x_i$, their standard deviation σ from the mean value $\bar{x}$ is determined using $$\left[\frac{1}{N} \times \Sigma(x_i^2 - x^{-2})\right]^{1/2} \quad (4)$$

For filtering out the signal fluctuations based on the eccentricities ΔR from the sampled difference signal, the sampling is carried out as a function of the roll rotational speed n. For this purpose, a control pulse transmitter 26 is provided which controls the sampling element 24 and the control pulse frequency of which on the output side is controlled as a function of the roll rotational speed n measured with the tachometer 10. Since the observation period on which the statistical evaluation of the signal fluctuation is based comprises a prescribed number of N reference points $x_i$, the observation period is also automatically matched to the respective roll rotation period.

Figure 2:
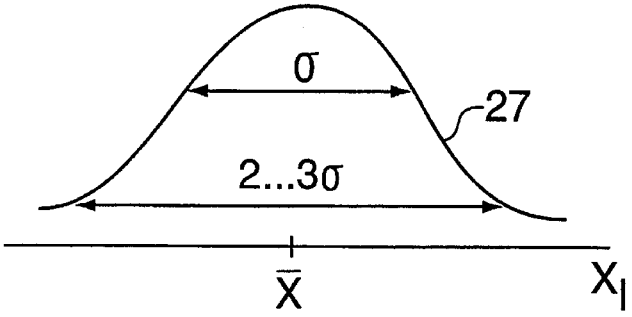
FIG. 2 shows an example for setting the width of the dead zone as a function of the standard deviation of the recorded signal fluctuations.

In FIG. 2, an example of the statistical frequency distribution 27 of the reference points $x_i$ in a prescribed observation period is shown in a diagram. Furthermore, the associated standard deviation σ is plotted in the diagram. In order also to take sufficiently into account the residual fluctuations, of the reference points $x_i$, lying outside the standard deviation, the value determined for the standard deviation σ is multiplied, in a correction element 28 arranged downstream of the device 25, by a prescribed factor in the range between 2 and 3, before it is fed to a control input 29 of the limiter 15 for setting the zone width b.

Figure 3:
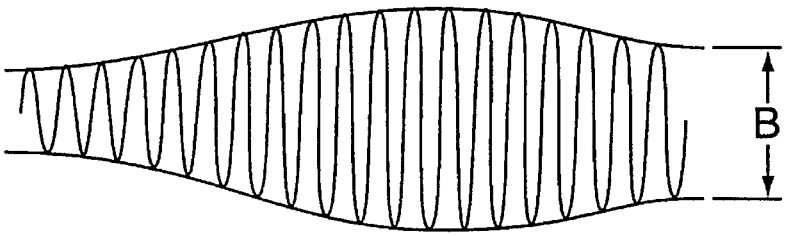
FIG. 3 shows an example for the course of the signal fluctuations and the dead zone matched thereto.

Shown in FIG. 3 is an example of the course of the signal fluctuations, caused by the eccentricities ΔR, at the output of the summing point 13, together with the zone width b controlled as a function thereof.

Figure 4:
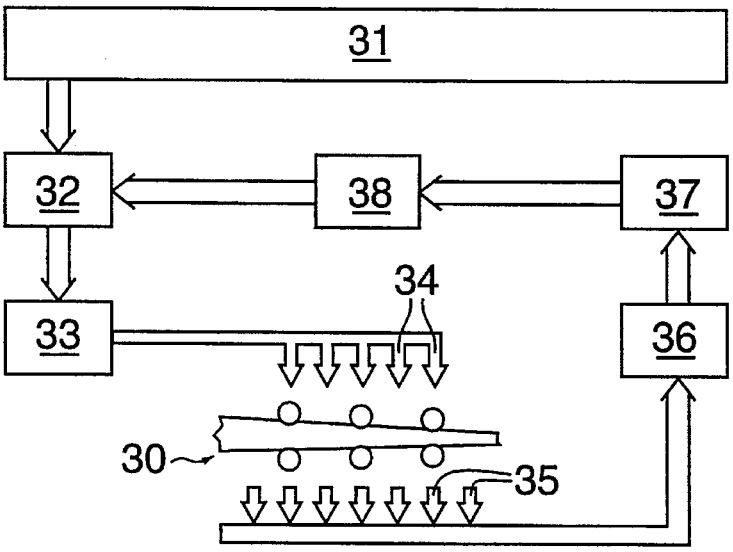
FIG. 4 shows an example of the computing procedure in the case of a rolling process control.

To explain the improvement of the controlled variables, including the zone width b of the dead zone, in the control for a roll stand or a complete rolling train on the basis of the techniques of processing fuzzily determined input variables, reference is made hereinafter to FIG. 4, which shows the individual blocks of the control of a rolling train 30. In this case, 31 designates the primary data input, for example the input dimensions, the material quality and the target variables of the rolling process. The primary data are suitably prepared in terms of control and are presented to a primary calculation 32 which calculates the rolling variables and the setting values for the rolling train. From the primary calculation 32, the data pass into a temporally correct distributor 33 for the setting values of cascaded open-loop and closed-loop controllers 34 of the rolling train 30, shown here only schematically. On the rolling train 30 itself, measured values and installation signals are obtained by means of known sensors 35 of all types, for example for the electrical variables on the individual roll stands and for the strip condition between the stands and after the last stand, the signals being input to a measured value recording device 36 with statistical conditioning of the measured values. For the statistical conditioning, a confidence range and the standard deviation are determined, taking into account the installation relationships and the amplification of the feedback loop formed. Said feedback loop is closed via devices 37 and 38 for subsequent calculation and matching of the adaptation coefficients and for storing the adaptation coefficients and via the primary calculation block 32. This feedback loop is improved, according to the present invention, by means of the technique of control with fuzzily determined input variables, in particular by means of neural networks, as they are shown by way of example in FIG. 5. In this case, a new self-teaching behavior of the feedback loop is achieved, which leads to a considerable improvement of the result in terms of rolling.

Figure 5:
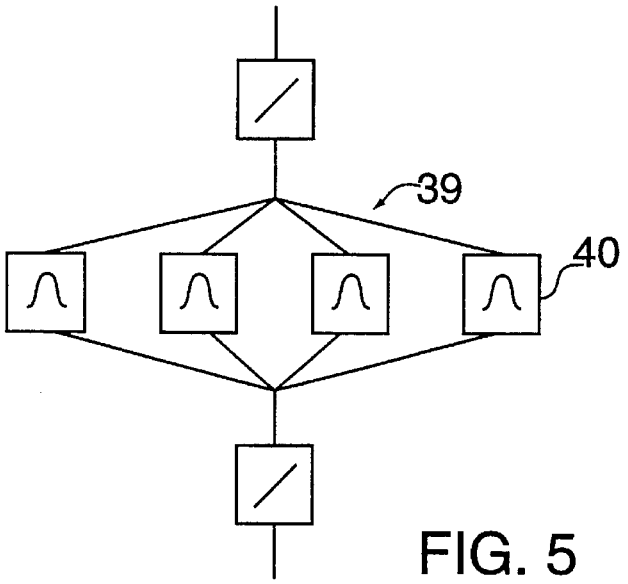
FIGS. 5 and 6 show exemplary designs of a neural computer network.
Figure 6:
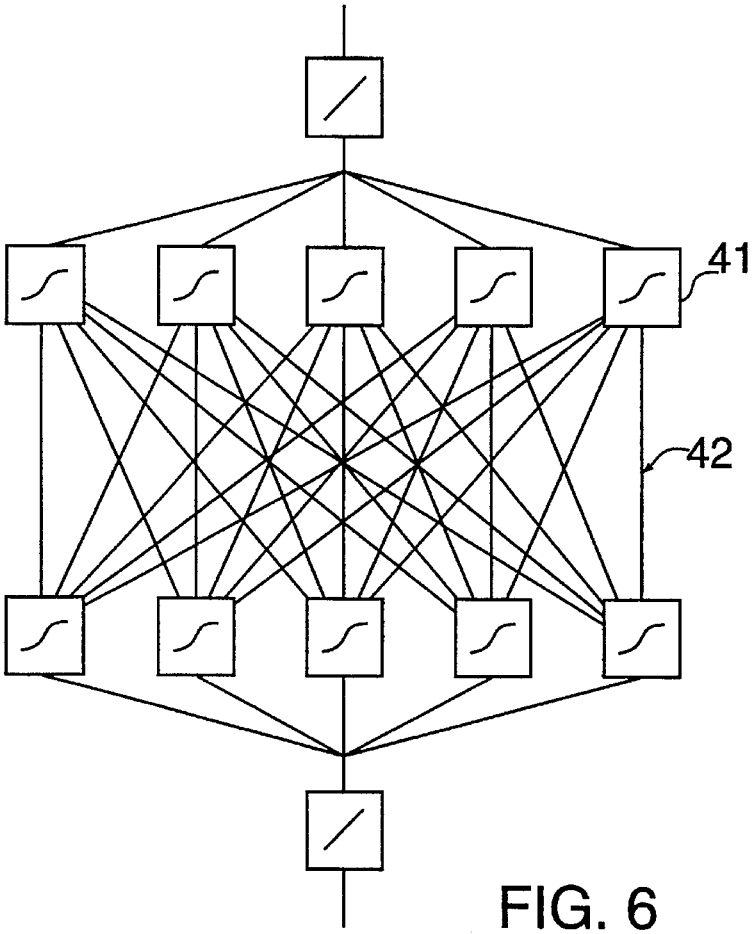

In FIG. 5, 39 designates a simple neural network well suited to strongly scattered values, the network nodes 40, as shown, having a local influence corresponding to Gauss curves. Networks according to FIG. 6 have network nodes 41 in the neural network 42 which are influenced sigmoidally. Networks of this type are likewise suitable, but less well, for the control and improvement of processes having less strongly scattered measured values and input variables.

I claim:

1. A method for controlling a thickness ($h_a$) of a rolled product in a roll stand, comprising the steps of:

a) suppressing an influence of roll eccentricities (ΔR) on control of the thickness ($h_a$) in the roll stand by providing a dead zone in the control, wherein the dead zone is insensitive to signal fluctuations caused by roll eccentricities (ΔR); and b) automatically varying a width (b) of the dead zone as a function of a magnitude of the signal fluctuations based on a continuous statistical evaluation of the signal fluctuations.

2. The method according to claim 1, further comprising the step of:

c) determining the dead zone width (b) using a standard deviation (σ) of the signal fluctuations from their mean value ($\bar{x}$).

3. The method according to claim 2, further comprising the step of:

d) weighting values continuously determined for the standard deviation (σ) by a prescribed factor on an order of approximately 1 to 4.

4. The method according to claim 2, further comprising the step of:

d) weighting values continuously determined for the standard deviation (σ) by a prescribed factor on an order of approximately 2 to 3.

5. The method according to claim 1, further comprising the step of:

c) using an observational period for the statistical evaluation of the signal fluctuations, which observation period corresponds to one roll rotation period or a multiple thereof.

6. The method according to claim 1, further comprising the step of:

c) recording a plurality of reference points (xi) from the signal fluctuations for statistical evaluation at a sampling frequency that has a fixed ratio with respect to a roll rotational speed (n).

7. The method according to claim 1, further comprising the step of:

c) using the signal fluctuations present at an input of the dead zone for the statistical evaluation of the signal fluctuations.

8. The method according to claim 1, further comprising the step of:

c) computing the zone width (b) and processing influencing variables in accordance with techniques for processing fuzzily determined input variables, in particular taking into account a measured value variability and distribution occurring in process variables.

9. The method according to claim 8, further comprising the step of:

d) using a neurally constructed network having a fuzzy structure or a fuzzy computing process for improving the controlled variables, in particular taking into account the measured value variability and distribution occurring in the process variables.

* * * * *